US007230197B2

(12) United States Patent
Sano et al.

(10) Patent No.: US 7,230,197 B2
(45) Date of Patent: Jun. 12, 2007

(54) MOVABLE CONTACT, MOVEABLE CONTACT UNIT INCLUDING THE SAME, AND SWITCH INCLUDING THE SAME MOVABLE CONTACT

(75) Inventors: Yoshiro Sano, Okayama (JP); Tetsuya Fukuda, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/511,449

(22) Filed: Aug. 29, 2006

(65) Prior Publication Data

US 2007/0102272 A1 May 10, 2007

(30) Foreign Application Priority Data

Nov. 10, 2005 (JP) ..... 2005-325680

(51) Int. Cl.
*H01H 5/30* (2006.01)

(52) U.S. Cl. ..... 200/406; 200/516

(58) Field of Classification Search ..... 200/406, 200/516, 520, 517
See application file for complete search history.

(56) References Cited

U.S. PATENT DOCUMENTS 4,476,355 A * 10/1984 Mital ..... 200/516
4,659,881 A * 4/1987 Dowe ..... 200/516
6,271,491 B1 * 8/2001 Ono et al. ..... 200/406
6,563,068 B2 * 5/2003 Yamagata et al. ..... 200/406
6,756,554 B1 * 6/2004 Hu ..... 200/406
6,855,900 B1 * 2/2005 Urushibata ..... 200/406
7,075,020 B2 * 7/2006 Asada ..... 200/406

FOREIGN PATENT DOCUMENTS

JP 2000-322974 11/2000

* cited by examiner

*Primary Examiner*—Michael A. Friedhofer
(74) *Attorney, Agent, or Firm*—Wenderoth, Lind & Ponack, L.L.P.

(57) ABSTRACT

A movable contact is made of a resilient and electrically conductive thin metal plate so that a depressing operation onto the top thereof allows turning over of the central section thereof. The movable contact is shaped like a dome bowing upward and open downward, and includes at least three projections radially placed at the center where the turn-over occurs. A top view of the projection shows a long and narrow shape extending in the radial direction. The downward protruding amount of the respective projections increases along the radial direction from the center to the outer side, and the respective projections each have a flat face having a given width along the circumferential direction. When the movable contact is in operation, the movable contact touches the object at an outer section of the flat face and along the circumferential direction.

8 Claims, 8 Drawing Sheets

MOVABLE CONTACT, MOVEABLE CONTACT UNIT INCLUDING THE SAME, AND SWITCH INCLUDING THE SAME MOVABLE CONTACT

FIELD OF THE INVENTION

The present invention relates to a movable contact to be used in a panel switch, which forms an input operating section for various electronic devices, and a movable contact unit using the same movable contact. The present invention also relates to a switch using the same movable contact.

BACKGROUND OF THE INVENTION

Panel switches have been widely used as switches employed in input operating sections of a variety of electronic devices. The panel switch is formed of a movable contact unit including a movable contact retained by a base sheet.

FIG. 9 shows a sectional view illustrating a part of a panel switch including a movable contact unit in which a conventional movable contact is used. FIG. 10 shows an exploded perspective view of the panel switch shown in FIG. 9. The conventional movable contact and the movable contact unit using the conventional movable contact are described hereinafter with reference to FIGS. 9 and 10.

In FIGS. 9 and 10, base sheet 101 made of insulating resin film covers the top faces of plural movable contacts 105. Each movable contact 105 is made of a resilient and electrically conductive thin metal plate, and has an external appearance of a circular dome bowing upward. Application of depressing force onto the center of the domed shape bows the domed shape downward, and removal of the depressing force restores the downward domed shape to its original shape due to the restoring force of the resilient metal plate. In other words, this conventional movable contact is an inside-out type movable contact.

At the center section of movable contact 105, hemispherical projections 107 protruding downward are formed at intervals of 120 degrees and equidistant from the center. Meanwhile an adhesive layer is formed on an underside of base sheet 101, and movable contact 105 is retained by the adhesive layer. This is generally called a movable contact unit.

Wired board 115 includes a fixed contact pair including outer contact 116 and center contact 117 opposing each one of plural movable contacts 105. Wired board 115 includes spacer member 102 on its top face, which has plural holes 103. Each one of movable contacts 105 is placed in respective holes 103. The top faces of respective movable contacts 105 are covered with base sheet 101.

Respective movable contacts 105 are placed corresponding to the place of each one of the pairs of outer contact 116 and center contact 117. An operating button (not shown) is placed corresponding to the place of movable contact 105, so that a panel switch is formed. This panel switch is mounted to an electronic device.

Each individual switch of the panel switch is structured this way: the lower end of an outer periphery of movable contact 105 is placed on outer contact 116, and the underside of the center section including hemispherical projections 107 confronts center contact 117 with a space in between. Base sheet 101, movable contact 105, and hemispherical projections 107 form movable contact unit 110.

The operation of the conventional panel switch discussed above is described hereinafter. An operating button (not shown) is depressed, thereby applying depressing force to the central section of corresponding movable contact 105 via base sheet 101. When the depressing force exceeds a given amount, movable contact 105 is turned over, and three hemispherical projections 107 are brought into contact with central contact 117. This mechanism allows outer contact 116 to become electrically conductive to corresponding central contact 117, so that the switch is turned on.

When the depressing force is removed, movable contact 105 restores to the original domed shape bowing upward due to its own restoring force. Then three hemispherical projections 107 leave central contact 117, so that outer contact becomes electrically open with respect to central contact 117.

The foregoing panel switch can be constructed with a light-weight and thin body, and can be operated by push-operation, so that they are widely used particularly in portable devices.

On the other hand, a single switch, e.g. as shown in FIG. 11, is also widely used in various electronic devices. The push-on switch shown in FIG. 11 comprises the following elements:

box-like housing 120 made of resin;

outer contact 121 and central contact 122 both placed on the inner bottom face of the recess of the opening;

movable contact 105 discussed above and placed on outer contact 121 at its outer periphery; and operating unit 125 movable up and down and built-in on movable contact 105.

The operation of this push-on switch is described hereinafter. Operating unit 125 is depressed for applying depressing force to the central section of movable contact 105, and when the depressing force exceeds a given amount, movable contact 105 turns over and three hemispherical projections 107 touch central contact 122 placed under projections 107. As a result, terminals respectively led out from outer contact 121 and central contact 122 become conductive to each other via movable contact 105. When the depressing force is removed from operating unit 125, movable contact 105 restores to its original shape and pushes up operating unit 125 to the original place, so that the terminals become electrically disconnected from each other again.

The prior art related to the present invention is, e.g. Unexamined Japanese Patent Publication No. 2000-322974.

When the switch formed of conventional movable contact 105 discussed above is used, the inside-out position of movable contact 105 causes hemispherical projections 107, which are placed at three places and formed independently of each other, to touch central contacts 117 or 122 placed under projections 107. However, the touching status is a point contact, and yet, hemispherical projections 107 touch central contacts 117 or 122 at generally determined points. When the switch has been frequently used, the counterpart points of central contacts 117 or 122 to projections 107 thus sometimes get dented.

SUMMARY OF THE INVENTION

The movable contact of the present invention is formed of conductive thin metal plate and is domed bowing upward and open downward, and the thin metal plate is resilient such that depressing force applied from above makes the domed plate change to an inside out condition.

The movable contact includes projections, which are placed at least at three places radially in the center that is to be turned over (inside out) when depressing force is applied.

A top view of the projection shows a long and narrow shape extending in a radial direction, and the projections protrude downward.

Respective projections are formed such that they protrude downward in a greater amount along the radius direction from the center to the outer side, and have a flat face having a given width along the circumferential direction. During the operation of the movable contact, the projections touch the corresponding object (counterpart contact) at the outer sections of the flat faces along the circumferential direction.

The foregoing structure allows the plural projections to come in linear-contact with the object independently. Contacting pressure per unit area can be thus dispersed appropriately, so that the contact with the object in a greater area than the conventional ones is achieved. As a result, use of this structure alleviates impact on the object. The contacting point is formed within the movable contact, yet near to an outer rim thereof along the radial direction, so that it happens rarely that foreign substance spans over two or more contacting points, and the substance is thus hardly bitten by the movable contact.

The movable contact unit of the present invention is formed by retaining the movable contact of the present invention with a base sheet.

The switch of the present invention is formed by placing the movable contact of the present invention opposite to the object (counterpart contact). This movable contact includes the following projections: the contacting points between the projections and the counterpart contact are set to be placed along a virtual circle, and a depressing member, having the area circled by the virtual circle or a greater area than this area, depresses the movable contact from the top and the movable contact turns over, so that the projections touch the object.

The construction discussed above allows the movable contact to alleviate the impact on the object such as the central contact even when the switch operation is frequently repeated over a long time. Thus the movable contact unit and the switch employing the movable contact having this feature are obtainable.

DETAILED DESCRIPTION OF PREFERRED EMBODIMENTS

Exemplary embodiments of the present invention are demonstrated hereinafter with reference to the accompanying drawings.

Exemplary Embodiment 1

Figure 1:
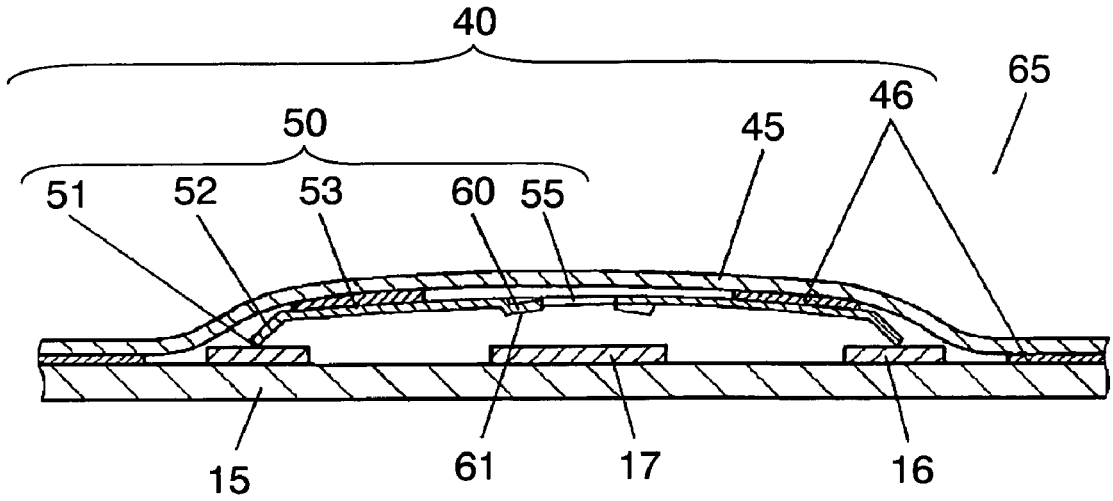
FIG. 1 shows a sectional view illustrating a part of a panel switch employing a movable contact unit having a movable contact in accordance with a first embodiment of the present invention.
Figure 2:
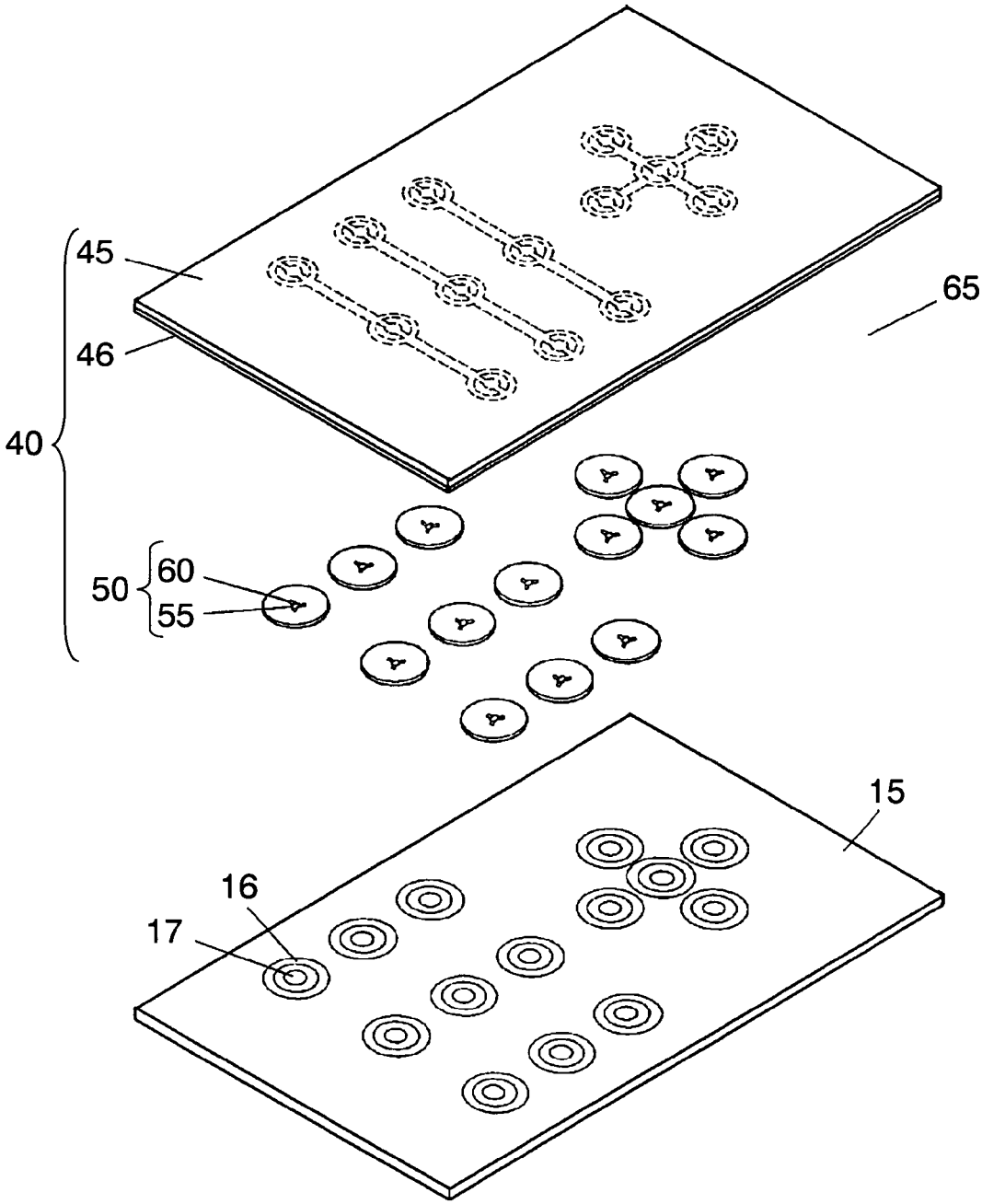
FIG. 2 shows an exploded perspective view of the panel switch shown in FIG. 1.
Figure 3:
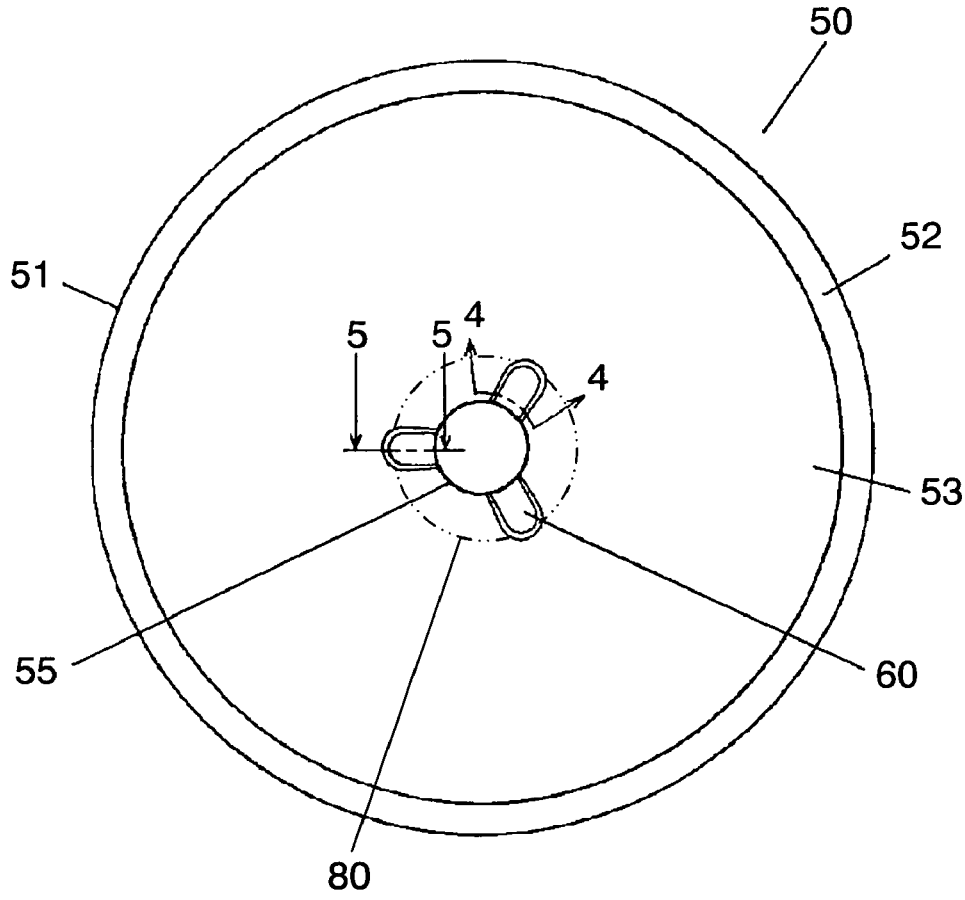
FIG. 3 shows a top view of the movable contact in accordance with the first embodiment.
Figure 4:
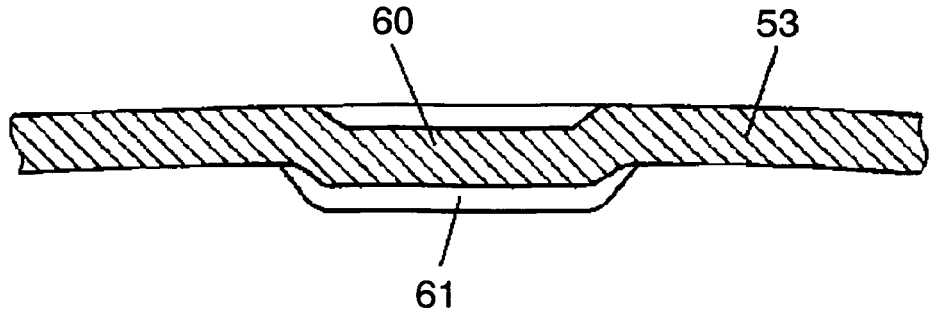
FIG. 4 shows a partial and enlarged sectional view cut along line 4—4 in FIG. 3.
Figure 5:
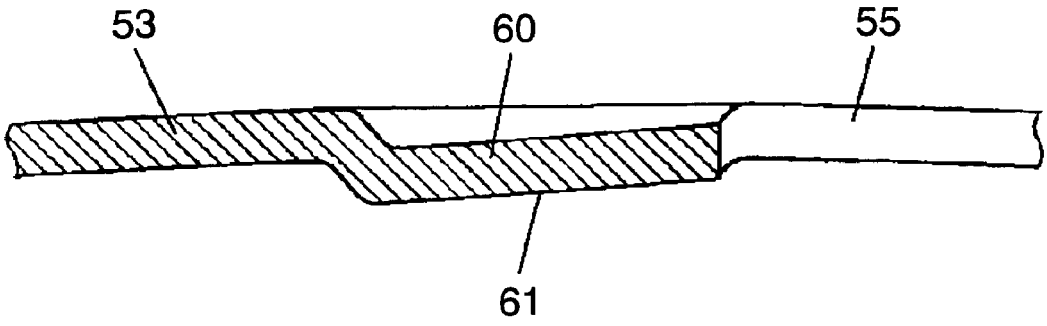
FIG. 5 shows a partial and enlarged sectional view cut along line 5—5 in FIG. 3.

FIG. 1 shows a sectional view illustrating a part of a panel switch employing a movable contact unit having a movable contact in accordance with the first embodiment of the present invention. FIG. 2 shows an exploded perspective view of the panel switch shown in FIG. 1. FIG. 3 shows a top view of the movable contact in accordance with the first embodiment of the present invention. FIG. 4 shows a partial and enlarged sectional view cut along line 4—4 in FIG. 3. FIG. 5 shows a partial and enlarged sectional view cut along line 5—5 in FIG. 3.

Movable contact 50 of the present invention is formed of resilient and electrically conductive thin metal plate having a central section which resiliently turns over upon being pressed from the top. Movable contact 50 is domed and bows upward and is open downward.

Movable contact 50 includes projections 60, which are placed at least at three places radially in the center which is to turn over, and the top view of projections 60 shows a long and narrow shape extending along the radial direction, and projections 60 protrude downward.

Respective projections 60 are formed such that they protrude downward in a greater amount along the radial direction from the center to the outer side, and have flat face 61 having a given width along the circumferential direction. During the operation of the switch, projections 60 touch the corresponding object (counterpart contact) at their outer sections of flat faces 61 along the circumferential direction.

Movable contact unit 40 is formed by retaining movable contact 50 with base sheet 45. Switch (panel switch) 65 is formed by placing movable contact 50 in response to the counterpart contact (central contact 17). Movable contact 50, movable contact unit 40 employing movable contact 50, and switch 65 employing movable contact 50 are detailed hereinafter.

In this first embodiment, switch 65 is described as panel switch 65; however, the switch is not necessarily the panel switch, and it can be another switch having the movable contact of the present invention.

In FIGS. 1 and 2, movable contact unit 40 comprises base sheet 45, adhesive layer 46, and movable contact 50. Base sheet 45 is made of resin film such as polyethylene terephthalate (PET). Plural movable contacts 50 are retained with adhesive layer 46 formed in a given pattern on the underside of base sheet 45 at their independent top faces.

As shown in FIG. 2, respective movable contacts 50 are placed correspondingly to an operating section of a device to which a panel switch is built-in. To be more specific, a contact pair including outer contact 16 and central contact 17 is placed on wired board 15 correspondingly to each one of the places of respective movable contacts 50. Each individual switch of panel switch 65 is structured this way: lower end 51 of the outer rim of movable contact 50 is placed on outer contact 16, and the underside of the central section of movable contact 50 including projections 60 confronts central contact 17 with a space in between.

Movable contact 50 is detailed hereinafter with reference to FIGS. 3–5. FIG. 3 shows a top view of the movable contact in accordance with the first embodiment of the present invention. FIG. 4 shows a partial and enlarged sectional view cut along line 4—4 in FIG. 3. FIG. 5 shows a partial and enlarged sectional view cut along line 5—5 in FIG. 3.

Movable contact 50 is made of a resilient and electrically conductive thin metal plate, and turns over due to the depressing force applied thereto. The shape of movable contact 50 includes lower end 51 of the outer rim, lateral slanting section 52 which slants upwardly from lower end 51 at a given angle, and spherical section 53 having a large curvature and covering the circular upper end of slanting section 52. Lateral slanting section 52 is linked to spherical section 53 with a given arc, so that the appearance of movable contact 50 looks like a circular dome bowing upward, and spherical section 53 turns over and bows downward when the depressing force is applied from the top thereof.

At the center of spherical section 53, projections 60 protruding downward are placed at three places radially at intervals of 120 degrees. The top view of each one of projections 60 shows a long and narrow shape extending in the radial direction. The foregoing placement of projections 60 is preferable; however, the angular interval is not limited to 120 degrees, and the number of projections can be more than three.

As shown in FIG. 4 (sectional view cut along line 4—4 in FIG. 3), each individual projection 60 protrudes downward where flat face 61 having a given width along the circular direction is formed. As shown in FIG. 5 (sectional view cut along line 5—5 in FIG. 3), the downward protruding amount increases along the radial direction, namely, a greater amount nearer to the outer rim than the central side. In other words, flat face 61 forms a long and narrow slanting face having a given width and extending along the radial direction.

The foregoing shape of projection 60 allows flat face 61 to come in linear contact with the object at the outer section where projection 60 protrudes in a greater amount. At this time, if spherical section 53 entirely turns over, the turn-over action can be done steadily, and yet, the angular status along the radial direction of each projection 60, namely, the slanting angle of flat face 61, varies appropriately to touch the object, so that a contacting point to the object can be self-cleaned. As a result, movable contact 50 excellent in stable contact is obtainable.

Projection 60 comes in liner-contact with the object at the outer side along the radial direction, so that a foreign substance entering rarely spans over two or more contacting points, and the foreign substance is hardly bitten by the movable contact 50. This structure helps improve the contact stability. Projection 60 is formed in a greater size than a conventional one, so that a greater radius can be used instead of an angular section in order to form a corner with ease.

Movable contact 50 further includes through-hole 55 at the center of spherical section 53, and through-hole 55 concentrically extends through spherical section 53 vertically. The end of through-hole 55 is formed together with the inner rim of projections 60 inclusively (refer to FIG. 3). The diameter of through-hole 55 such as shown in FIG. 3 can reduce tensile force within the metal thin plate at the central section, so that the shape of projection 60 can be formed advantageously with ease.

Movable contacts 50 including projections 60 discussed above are retained with base sheet 45, so that movable contact unit 40 is formed. Adhesive layer 46 provided to the underside of base sheet 45 has the pattern in which sections corresponding to air-escape grooves and through-hole 55 are omitted. Movable contacts 50 are adherently retained by adhesive layer 46 at their top faces. Adhesive layer 46 is formed in an arc at a given distance from the end of through-hole 55, and confronts movable contact 50.

As shown in FIG. 1, movable contact unit 40 is retained on wired board 15 by adhesive layer 46 formed on the underside of base sheet 45. On wired board 15, outer contacts 16 and central contacts 17 are placed correspondingly to the places of respective movable contacts 50. Movable contact unit 40 is used as one of the structural elements of panel switch 65. Depressing members, such as push buttons, placed correspondingly to movable contacts 50 are omitted from FIG. 1 and FIG. 2.

Panel switch 65 is formed of plural self-resetting push switches, and each of these switches comprises individual movable contact 50, outer contact 16 and central contact 17 corresponding to movable contact 50. Each push switch is formed this way: lower end 51 of the outer rim of movable contact 50 is placed on corresponding outer contact 16, and spherical section 53 of movable contact 50 includes flat face 61 of the underside of projection 60 and confronts corresponding central contact 17 with a given space in between.

The operation of panel switch 65 is demonstrated hereinafter. Depressing force is applied to spherical section 53 of movable contact 50 via base sheet 45 by pushing down an operating button. When the depressing force exceeds a given amount, spherical section 53 turns over with tactile feedback, and flat face 61 of the underside of projection 60 comes in line-contact with central contact 17 along the circumferential direction. Outer contact 16 thus becomes electrically conductive to central contact 17 via movable contact 50, so that the switch is turned on.

At this time, three projections 60 come in linear-contact with central contact 17 respectively, so that the contacting area becomes greater than the conventional one and a contacting pressure per unit area can be appropriately dispersed. The impact applied to central contact 17 can be thus alleviated, and central contact 17 becomes dented in fewer cases even if the switch is repeatedly used over a long period.

The contacting place is nearer to the outer side along the radial direction within movable contact 50, so that a foreign substance entering hardly spans over two or more than two contacting points or the substance is hardly bitten by the movable contact. Thus steady on-off actions at multi contacting points can be expected. On top of that, during the foregoing operation, air-flow occurs between the inside and the outside of movable contact 50 via through-hole 55 provided at the center of movable contact 50, so that the air included in contact 50 less affects the performance of movable contact 50.

When the depressing force is removed from movable contact 50, spherical section 53 pushes back base sheet 45 with tactile feedback and restores it to its original shape, i.e. bowing upward as shown in FIG. 1. As a result, projection 60 leaves central contact 17, which then becomes electrically open with respect to outer contact 16, so that the switch becomes turned off. At this time, the air-flow occurs again between the inside and the outside via through-hole 55, so that the restoring movement can be done smoothly.

As discussed above, movable contact unit 40 employing movable contact 50 is mounted to an electronic device as panel switch 65, and unit 40 can alleviate the impact on central switch 17, so that unit 40 helps improve the operation durability of the electronic device.

Exemplary Embodiment 2

Figure 6:
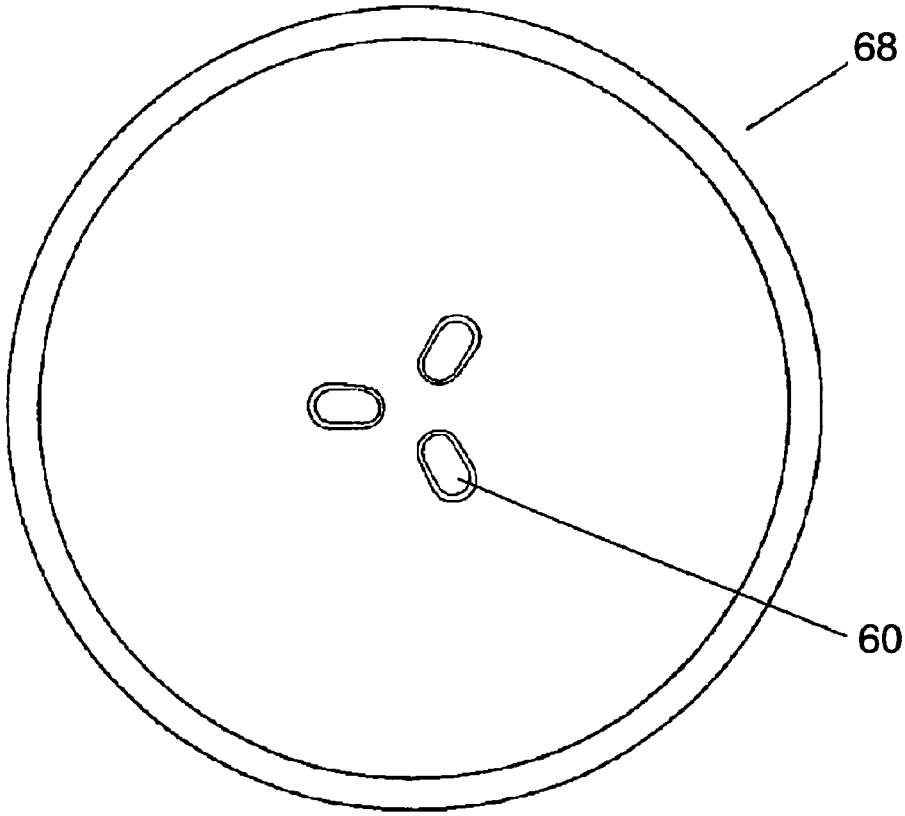
FIG. 6 shows a top view of the movable contact in accordance with a second embodiment.
Figure 7:
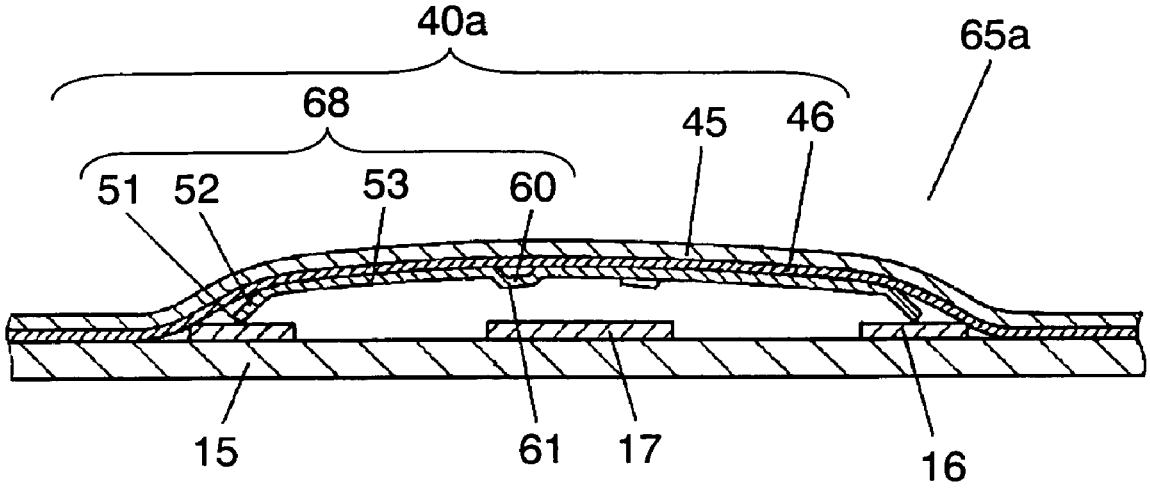
FIG. 7 shows a sectional view in part of a panel switch formed of a movable contact unit employing the movable contact shown in FIG. 6.

FIG. 6 shows a top view of the movable contact in accordance with the second embodiment. FIG. 7 shows a sectional view in part of a panel switch formed of a movable contact unit employing the movable contact shown in FIG. 6. Movable contact 68 in accordance with the second embodiment has projections 60 similar to those described in the first embodiment; however, movable contact 68 does not have a through-hole at the center.

Movable contact unit 40*a* employing contact 68 as shown in FIG. 7 or panel switch 65*a* employing unit 40*a* produces an advantage similar to that obtained in the first embodiment. Except the structures discussed above, the other structures remain almost unchanged from the first embodiment, so that detailed descriptions are omitted here.

The method of retaining movable contact 50 or 68 with base sheet 45 can be different from the one discussed previously, and the object (counterpart contact) for movable contact 50 or 68 to touch can be other than the ones discussed previously.

Movable contact 50 or 68 can be mounted to a flexible film such as an EL (electro-luminescence) element instead of to base sheet 45. Movable contact 50 or 68 can be provided just for producing tactile feedback for alleviating an impact against the object.

Exemplary Embodiment 3

Figure 8:
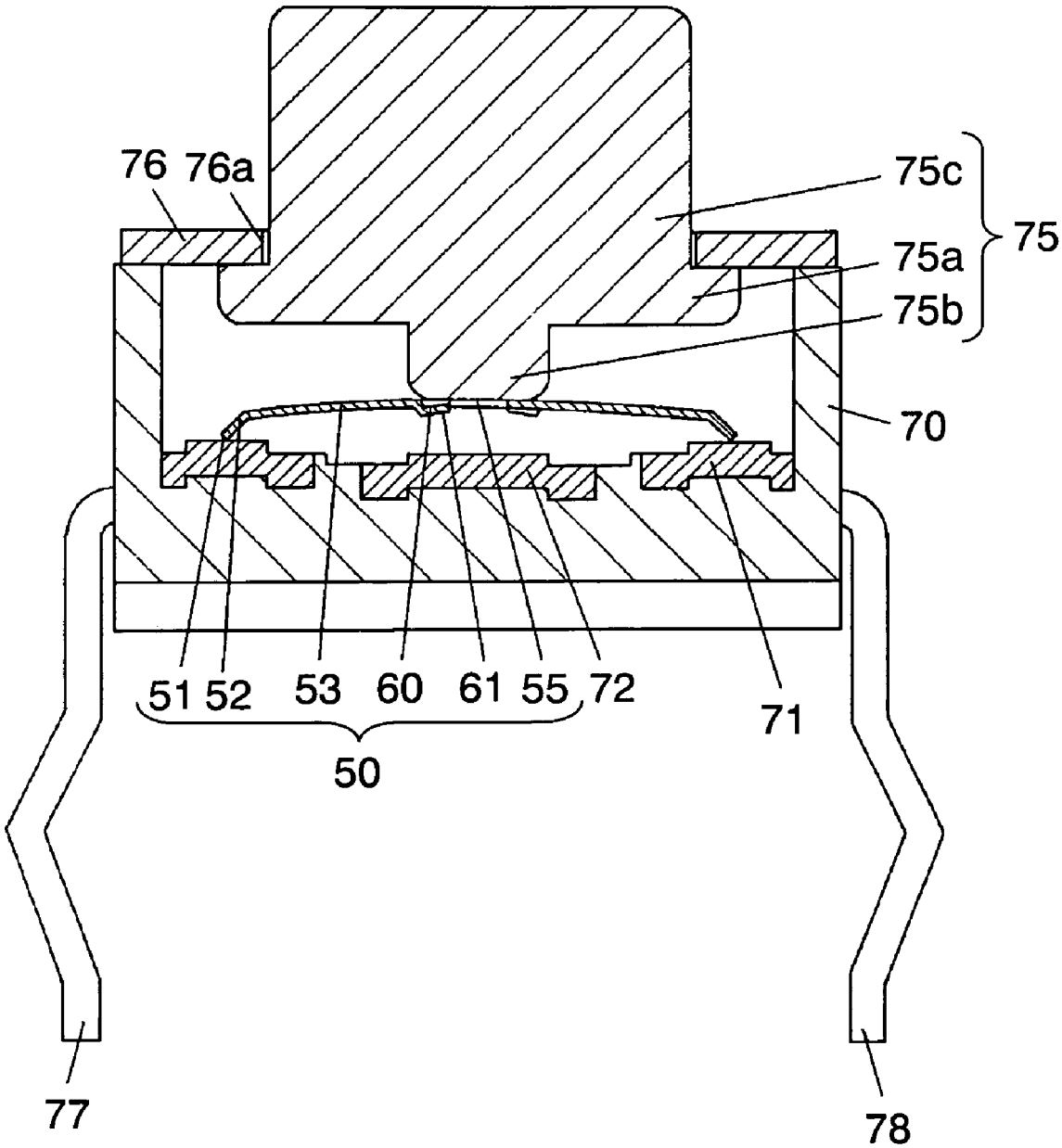
FIG. 8 shows a sectional view of a single push-on switch in accordance with a third embodiment of the present invention, and the push-on switch employs the movable contact of the present invention.
Figure 9:
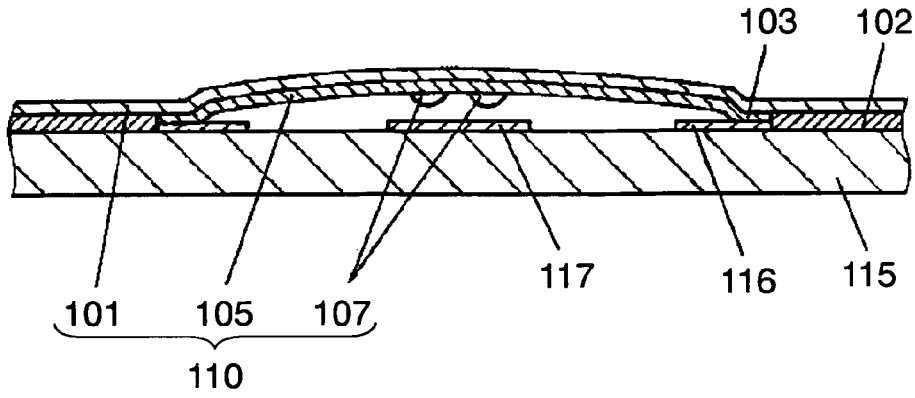
FIG. 9 PRIOR ART
FIG. 9 shows a sectional view in part of a panel switch formed of a movable contact unit employing a conventional movable contact.
Figure 10:
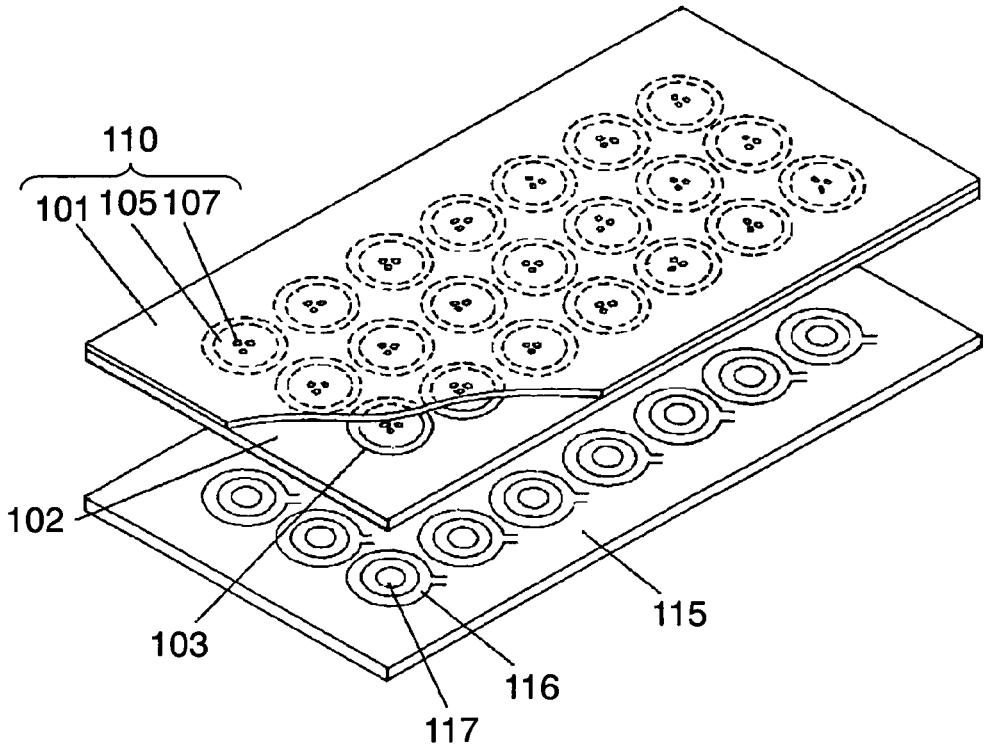
FIG. 10 PRIOR ART
FIG. 10 shows an exploded perspective view of the panel switch shown in FIG. 9.
Figure 11:
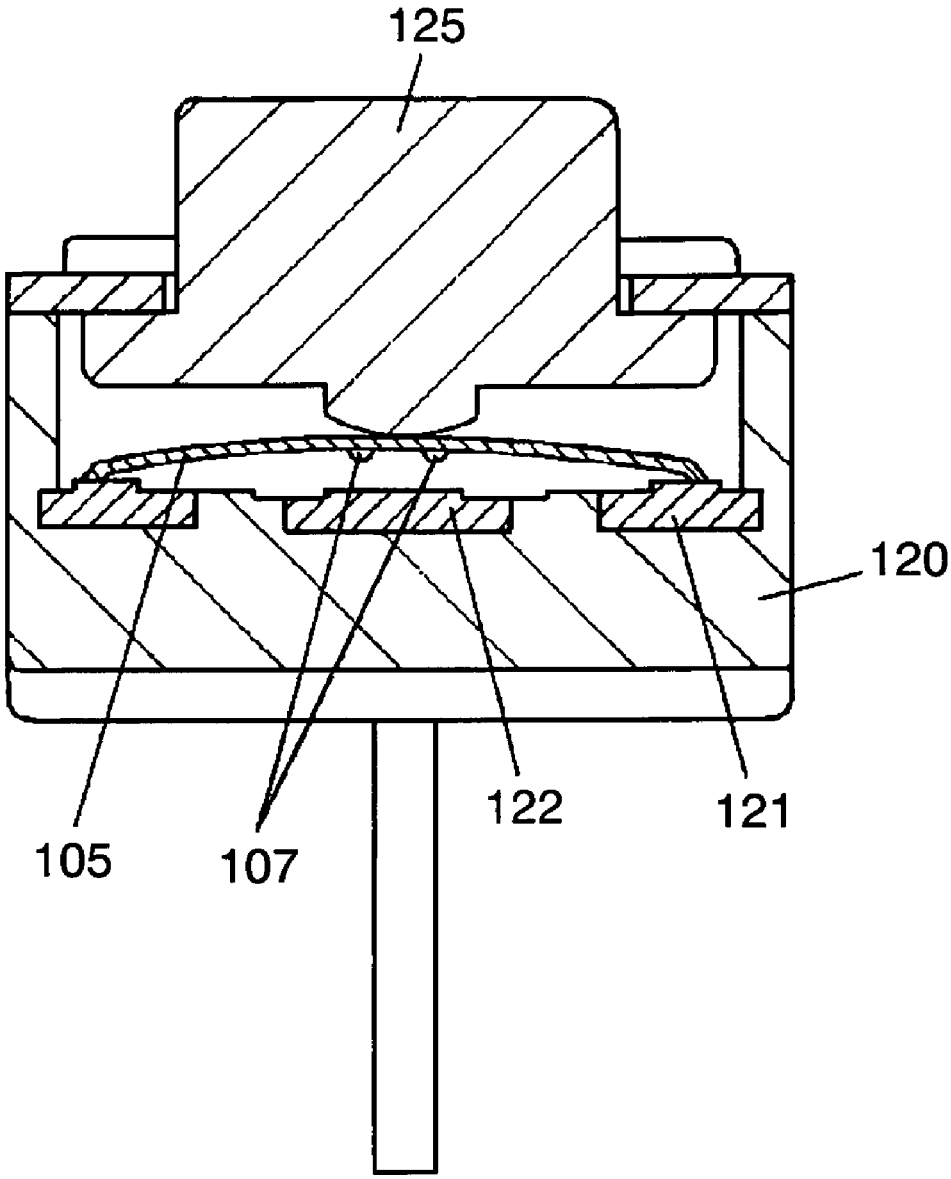
FIG. 11 PRIOR ART
FIG. 11 shows a sectional view of a conventional single push-on switch employing the conventional movable contact.

A single push-on switch can be formed by using movable contact 50 or 68. FIG. 8 shows a sectional view of the single push-on switch in accordance with the third embodiment of the present invention, and the push-on switch employs the movable contact of the present invention. In this third embodiment the single push-on switch is described, and the description of movable contact 50 is omitted here because it is already described in connection with the first embodiment.

As shown in FIG. 8, the push-on switch in accordance with the third embodiment includes box-like housing 70 made of resin, open upward and having outer contact 71 and central contact 72 on the recessed bottom face of the opening. Lower end 51 of the outer rim of movable contact 50 is placed on outer contact 71, and spherical section 53 of movable contact 50 supports operating unit 75 which operates as a depressing member movable vertically.

Operating unit 75 has downward projection 75*b* and upward projection 75*c* with flange 75*a* as a boundary in between. Downward projection 75*b* is placed on spherical section 53, and upward projection 75*c*, working as an operating section, protrudes upward through central hole 76*a* of cover member 76 which covers the opening of box-like housing 70. Operating unit 75 is halted during the non-operation because the top face of flange 75*a* is brought into contact with the underside of cover member 76. The operation of this push-on switch is demonstrated hereinafter.

Upward projection 75*c* of operating unit 75 is depressed, and spherical section 53 receives the depressing force via downward projection 75*b*. The depressing force allows movable contact 50 to turn over, and the respective undersides, i.e. flat faces 61, of three projections 60 come in linear contact with central contact 72 along the circumferential direction and having a given width. As a result, outer contact 71 becomes electrically conductive to central contact 72 via movable contact 50, and terminals 77 and 78 led out from respective contacts 71 and 72 to the outside of box-like housing 70 become conductive to each other. The single push-on switch discussed above produces an advantage, e.g. alleviating an impact on central contact 72, similar to that in the first and second embodiments.

When the operating force is removed from operating unit 75, movable contact 50 restores to its original shape, i.e. bowing upward, and pushes up operating unit 75 to its original place. Then projection 60 leaves central contact 72, and outer contact 71 becomes open with respect to central contact 72. In other words, terminals 77 and 78 corresponding to outer contact 71 and central contact 72 become electrically disconnected from each other.

This single push-on switch is not limited to the structure discussed above. The foregoing movable contact unit is also not limited to the foregoing structure. The scope of the present invention covers the movable contacts including projections 60 discussed above, and any such movable contacts allow extending a service life of the switches, so that the movable contacts helps improve the operation durability of the electronic devices.

As discussed above, according to the present invention, a contacting section of the movable contact is shaped like the foregoing projection, thereby allowing the switch or semi-finished products employing the movable contact to alleviate an impact on the object of the movable contact. The present invention thus helps extend the service life of the switch or the semi-finished products which employ the movable contact.

The movable contact is shaped like a dome bowing upward, and is formed of lateral slanting section 52 and spherical section 53 having a greater curvature and covering the circular upper end of lateral slanting section 52. Turn-over or inside-out of entire spherical section 53 is preferable because it involves a greater area to be turned over, so that stable contact of projection 60 can be expected.

Exemplary Embodiment 4

The movable contact in accordance with the fourth embodiment is shaped like a dome bowing upward and includes projections protruding downward. The movable contact is made of resilient and electrically conductive metal thin plate. The contacting positions of the projections with respect to their object are set to be placed along a virtual circle. A depressing member having an area equal to or greater than the area circled by the virtual circle depresses the movable contact from the top, so that the movable contact turns over and the projections touch the object.

The movable contact in accordance with the fourth embodiment is described hereinafter with reference to FIGS. 1, 3 and 8. Movable contact 50 shown in FIG. 1 has projections 60. The contacting positions of respective projections 60 relative to the object are set to be placed along the virtual circle concentric with spherical section 53 or its external form. This arrangement is preferable because when spherical section 53 turns over, respective projections 60 touch the object at the same time. The virtual circle is shown, e.g. by the area in FIG. 3 marked with the alternate long and two short dash line denoted by reference mark 80.

The size of the area depressed by the depressing member, i.e. operating unit 75, which causes the turn over action, is preferably equal to or slightly greater than the area circled by the virtual circle. This shape allows the depressing member, namely, operating unit 75, to apply its depressing force simply to the contacting positions of projections 60, so that more stable contact can be expected.

The idea of how to set the area depressed by the depressing member is not limited by the shape of projection 60. For instance, the idea can be applied to the movable contacts having conventional hemispherical projections with an advantage similar to what is discussed above.

The foregoing discussion proves that the movable contact of the present invention, the movable contact unit employing the movable contact, and the switch employing the movable contact are equipped with contacting sections which can alleviate an impact on the object, namely, the counterpart contact. Thus those products of the present invention help improve the operation durability of the electronic devices including a case of the operation repeated frequently over a long period. The present invention is therefore useful for structuring an input operating section for various electronic devices.

What is claimed is:

1. A movable contact made of resilient and electrically conductive thin metal plate of which a central section is turned over by depressing a top of the movable contact, the movable contact being shaped like a dome bowing upward and open downward, and comprising:

projections placed at least at three places radially at a center where turn-over occurs, and a top view of the projections shows each of the projections having a long and narrow shape extending along a radial direction, and the projections each protrude downward, wherein a downward protruding amount of each one of the projections is set such that each of the projections protrudes in a greater amount along the radial direction from the center to an outer side, and each one of the projections includes a flat face having a given width along a circumferential direction, and wherein during operation of the movable contact, the projections touch an object at an outer section of the flat face along the circumferential direction.

2. The movable contact of claim 1, wherein the contact is a linear-contact.

3. The movable contact of claim 1, wherein a central hole extending vertically through the central section of the movable contact is provided.

4. The movable contact of claim 1, wherein contacting positions of the projections with respect to the object are set to be placed along a virtual circle, and the projections are depressed by a depressing member having an area equal to or greater than an area circled by the virtual circle to turn over, so that the projections touch the object.

5. A movable contact unit formed of a movable contact retained by a base sheet, wherein the movable contact is made of a resilient and electrically conductive thin metal plate of which a central section is turned over by depressing a top of the movable contact, the movable contact being shaped like a dome bowing upward and open downward, and the movable contact includes projections placed at least at three places radially at a center where turn-over occurs, and a top view of the projections shows each of the projections having a long and narrow shape extending along a radial direction, and the projections protrude downward, wherein a downward protruding amount of each one of the projections is set such that each of the projections protrudes in a greater amount along the radial direction from the center to an outer side, and each one of the projections includes a flat face having a given width along a circumferential direction, and wherein during operation of the movable contact, the projections touch an object at an outer section of the flat face along the circumferential direction.

6. The movable contact unit of claim 5, wherein a central hole extending vertically through the central section of the movable contact is provided.

7. A switch including a movable contact placed corresponding to a counterpart contact, wherein the movable contact is made of a resilient and electrically conductive thin metal plate of which a central section is turned over by depressing a top of the movable contact, the movable contact being shaped like a dome bowing upward and open downward, and the movable contact includes projections placed at least at three places radially at a center where turn-over occurs, and a top view of placement of the projections shows each of the projections having a long and narrow shape extending along a radial direction, and the projections protrude downward, wherein a downward protruding amount of each one of the projections is set such that each of the projections protrudes in a greater amount along the radial direction from the center to an outer side, and each one of the projections includes a flat face having a given width along a circumferential direction, and wherein during operation of the movable contact, the projections touch an object at an outer section of the flat face along the circumferential direction.

8. The switch of claim 7, wherein a central hole extending vertically through the central section of the movable contact is provided.

* * * * *